United States Patent [19]

Lawson

[11] 4,449,583

[45] May 22, 1984

[54] WELL DEVICES WITH ANNULUS CHECK VALVE AND HYDRAULIC BY-PASS

[75] Inventor: John E. Lawson, London, England

[73] Assignee: ARMCO Inc., Middletown, Ohio

[21] Appl. No.: 304,078

[22] Filed: Sep. 21, 1981

[51] Int. Cl.[3] ..... E21B 34/10; E21B 34/12

[52] U.S. Cl. ..... 166/72; 166/87; 166/321; 166/332

[58] Field of Search ..... 166/72, 86, 87, 133, 166/123–125, 188, 321, 325, 332, 344, 348, 360, 362, 368, 373–375, 382, 386, 97; 251/321, 343, 344

[56] References Cited

U.S. PATENT DOCUMENTS

| | | | |
|---|---|---|---|
| 2,080,610 | 5/1937 | Humason | 166/90 |
| 3,171,489 | 3/1965 | Cole et al. | 166/66.5 |
| 3,310,107 | 3/1967 | Yancey | 166/72 |
| 3,324,951 | 6/1967 | Balmer et al. | 166/330 X |
| 3,492,026 | 1/1970 | Ahlstone | 166/87 |
| 3,739,846 | 6/1973 | Beson | 166/89 |
| 3,786,863 | 1/1974 | Tausch | 166/72 |
| 4,109,712 | 8/1978 | Regan | 166/87 |
| 4,333,526 | 6/1982 | Watkins | 166/72 |

*Primary Examiner*—Ernest R. Purser
*Assistant Examiner*—Hoang C. Dang
*Attorney, Agent, or Firm*—Roylance, Abrams, Berdo & Goodman

[57] ABSTRACT

Hanger apparatus for suporting pipe in a well, the apparatus including both an annulus check valve, via which communication is established with the annulus between the suspended pipe and surrounding casing, and a pressure fluid by-pass, via which communication with a down-hole device such as a safety valve is established. Opening of the check valve and establishment of communication via the by-pass are accomplished by a simple stabbing operation with, e.g., a handling tool or a production upper body. Alternately, the check valve is opened by hydraulic pressure delivered via the production upper body.

31 Claims, 11 Drawing Figures

FIG. 2
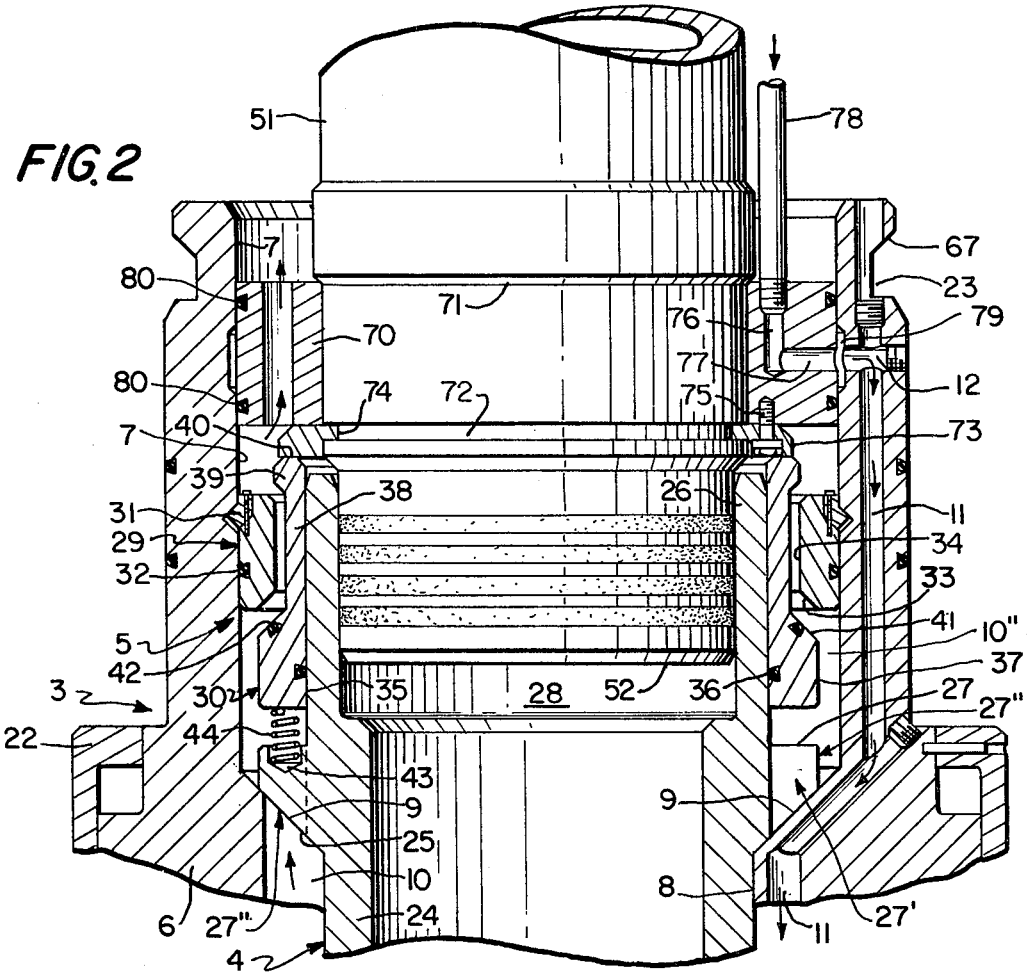
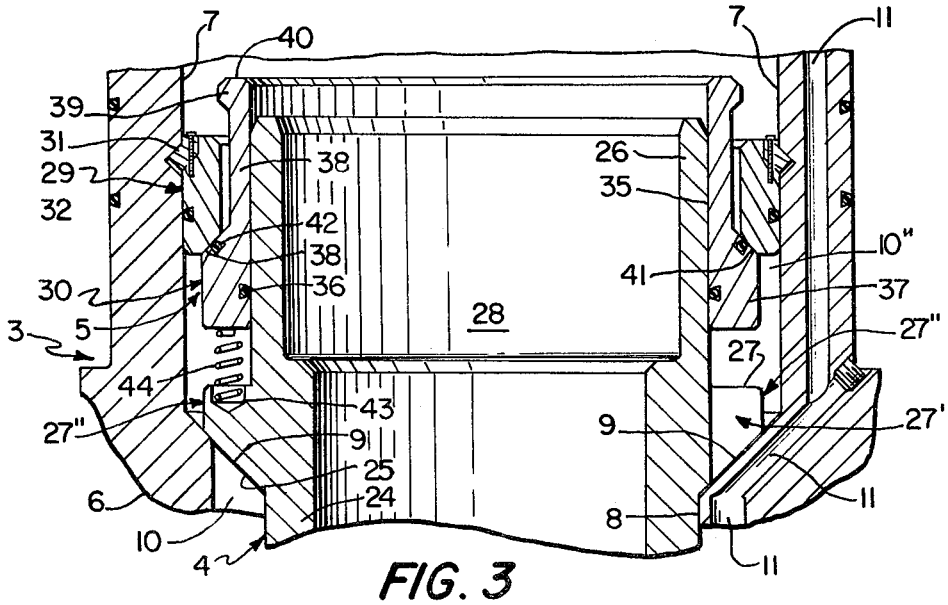
FIG. 3

WELL DEVICES WITH ANNULUS CHECK VALVE AND HYDRAULIC BY-PASS

This invention relates to well devices, typically tubing hangers, having an annulus check valve and by-pass means for hydraulic control of down-hole devices such as safety valves.

BACKGROUND OF THE INVENTION

When pipe, such as a tubing string, is hung in a well, it is desirable to provide access through the pipe hanger to the annulus surrounding the pipe and to automatically close that annulus when, for example, the handling string by which the hanger was landed is removed. This has been accomplished in the prior art by equipping the hanger with a check valve which is held open so long as, e.g., the hanger is attached to the handling string but closes automatically when the handling string is disconnected from the hanger. Such apparatus is disclosed, for example, in U.S. Pat. No. 3,171,489 issued Mar. 2, 1965, to Charles M. Cole et al. Annulus check valve-equipped pipe hangers have been successfully employed in numerous underwater well installations. The problem has become more complicated, however, because of an increasing need to have valve-controlled access to the annulus between well tubing and a casing string surrounding the tubing, coupled with a requirement for pressure fluid-actuated down-hole devices such as a down-hole safety valve. In such cases, the pressure fluid lines to control the down-hole safety valve are accommodated by the annulus to which access via the check valve must be provided, and it has proved difficult to devise a dependable valve and still accommodate the pressure fluid lines. The problem is further complicated by the need to establish all of the necessary connections by simple stab-in operations. There has accordingly been a continuing need for improvement of annulus check valve equipped pipe hangers.

OBJECTS OF THE INVENTION

A general object of the invention is to provide improved well devices equipped with both an annulus check valve and pressure fluid ducting for controlling down-hole devices.

Another object is to devise a pipe hanger with a simple annulus check valve by-passed by at least one pressure fluid duct.

A further object is to provide such hanger apparatus to which handling tools, production upper bodies and the like can be connected by simple stab-in operations with no orientation alignment required.

SUMMARY OF THE INVENTION

Pipe hanging apparatus according to the invention are adapted to be landed on a support surface presented by, e.g., a wellhead structure, and include means on the hanger member presenting an upper wall portion of larger diameter and, spaced inwardly from that wall portion, an upwardly projecting tubular portion. Typically, the wall portion of larger diameter can be the upper portion of the through bore of the hanger member and the upwardly projecting tubular portion can be the upper end portion of a hanger mandrel supported in the through bore of the hanger member. Provision is made for flow between the annulus below the hanger member and the annular space between the larger diameter upper wall portion and the upwardly projecting tubular portion. The annulus check valve is disposed in that annular space and comprises an upper annular member presenting a downwardly directed valve seat, a movable annular member presenting an upwardly directed valve surface adapted to coact with the seat, and yieldable means acting on the movable annular member in a direction to close the valve. Advantageously, the upper annular member is carried by the larger diameter upper wall portion of the hanger member, and the movable annular member slidably embraces the upwardly projecting tubular portion. The movable annular member of the valve has an upwardly exposed actuating surface to be engaged by a valve actuating element on the handling tool, by which the hanger is landed, and also by a like valve actuating element on the production body installed during completion, the valve actuating element in each case forcing the lower annular element downwardly to open the valve. The hanger member is also provided with a pressure fluid by-pass duct which is external to the through bore of the hanger and has an upper opening, to communicate by stab connection with pressure fluid ducts in the handling tool and the production body, and a lower opening communicating with the annulus below the hanger member. In a second embodiment of the invention, the check valve is opened by landing of the handling tool or by hydraulic pressure from a production upper body which has replaced the handling tool.

IDENTIFICATION OF THE DRAWINGS

In order that the manner in which the foregoing and other objects are achieved, one particularly advantageous embodiment of the invention will be described with reference to the accompanying drawings, which form part of the original disclosure of this application, and wherein:

FIG. 2 is a fragmentary vertical sectional view of a portion of the apparatus of FIG. 1, showing the annulus check valve held open by the handling tool;

FIG. 3 is a view similar to FIG. 2 but showing the valve closed after removal of the handling tool;

Figure 8:
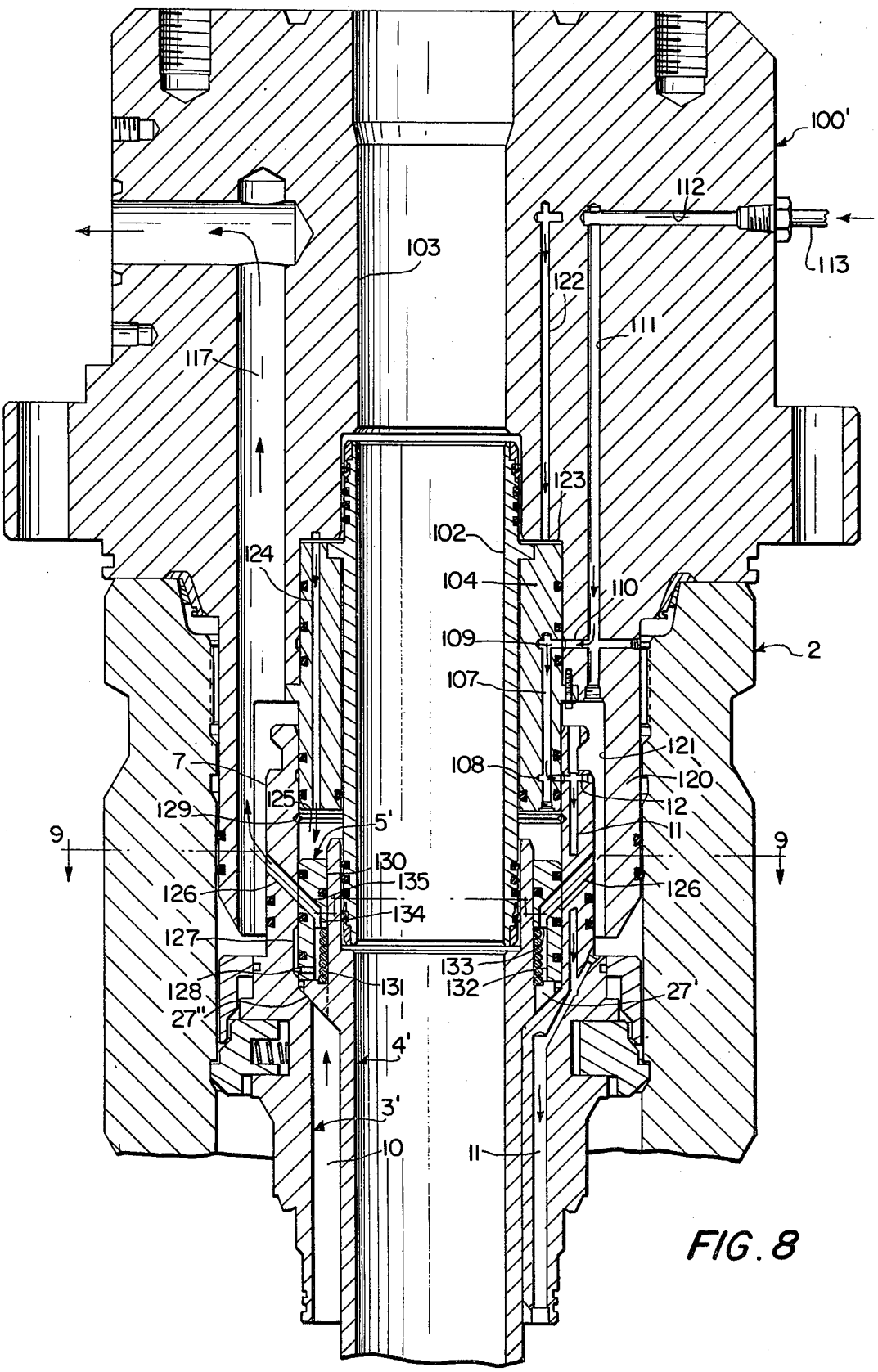
FIG. 8 is a vertical cross-sectional view of a modified hanger apparatus showing a modified annulus check valve held open by hydraulic pressure from a modified production upper body landed on the production lower body.
Figure 10:
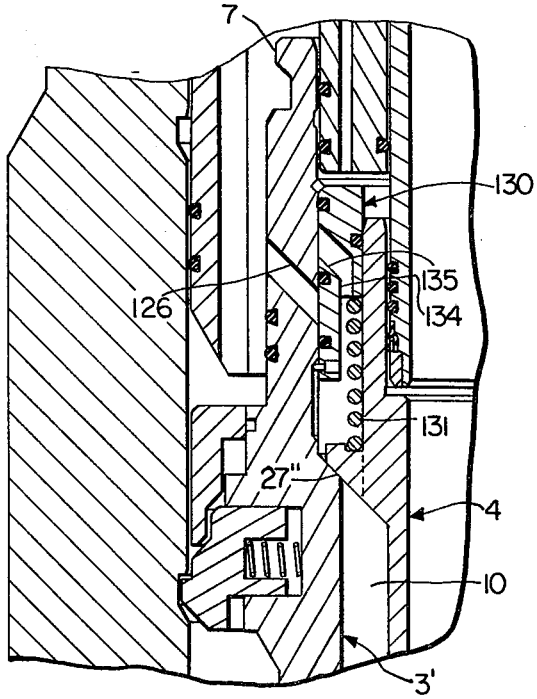
Figure 11:
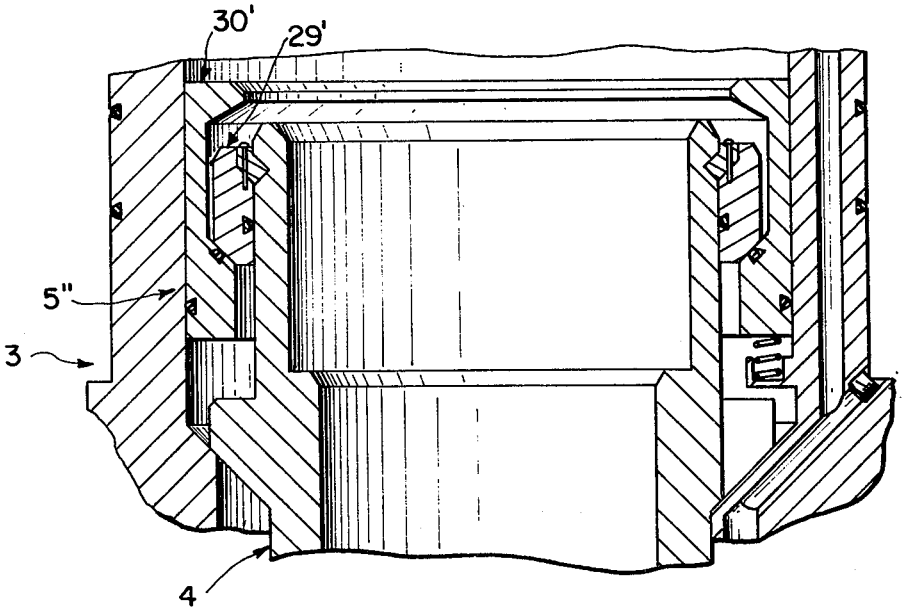

FIG. 10 is a fragmentary vertical sectional view of a portion of the apparatus of FIG. 8 showing the annulus check valve closed by a spring after release of the hydraulic pressure; and FIG. 11 is a fragmentary vertical sectional view similar to that shown in FIG. 3 illustrating the annulus check valve closed after removal of the handling tool except that the annular member 29' is rigidly coupled to mandrel 4 and the movable annular member 30' is slidably engaging the hanger member 3.

DETAILED DESCRIPTION OF THE INVENTION SHOWN IN FIGS. 1-7

Figure 1:
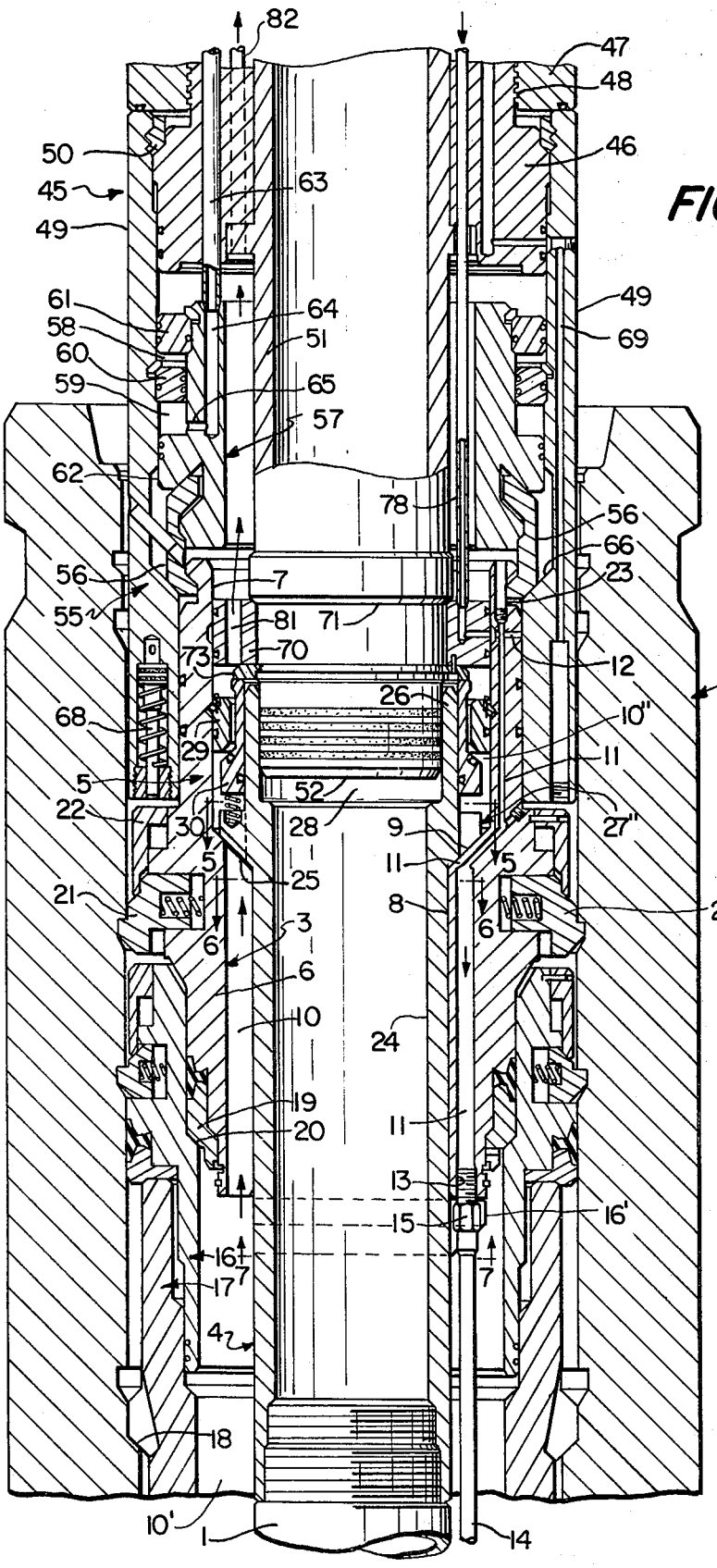
FIG. 1 is a vertical cross-sectional view of hanger apparatus according to the invention, landed in an underwater wellhead lower body, with a multifunction handling tool connected to the hanger apparatus.

FIGS. 1 and 2 illustrate hanger apparatus according to one embodiment of the invention for hanging a single string of tubing 1, FIG. 1, in an underwater well installation comprising a wellhead lower body 2. The hanger apparatus includes an outer hanger member 3, an inner hanger mandrel 4, and an annulus check valve indicated generally at 5.

Hanger member 3 comprises an integral body 6 having a through bore including an upper portion 7 of larger diameter and a lower portion 8 of smaller diameter, the two bore portions being interconnected by a frustoconical downwardly and inwardly tapering support shoulder 9. Hanger member 3 also has a pressure fluid by-pass duct 11 extending from a lateral bore 12, which opens inwardly through the wall of upper through bore portion 7 near the top of the hanger member and thus provides the upper opening of the by-pass duct, to a lower opening 13 to which a tube 14 is connected by fitting 15, tube 14 extending beside tubing string 1 to a conventional down-hole safety valve (not shown).

At its lower end, hanger member 3 is dimensioned for downward insertion into the bore of a pack-off device 16 seated on a casing hanger 17 which is in turn seated on a shoulder 18 in the bore of wellhead body 2. Hanger member 3 is equipped with an outer seal device, of the type disclosed in U.S. Pat. No. 3,268,241 issued Aug. 23, 1966, to Castor et al, which includes a lower ring 19 seated on a shoulder 20 in the bore of pack-off device 16 so that, once landed on shoulder 20, hanger member 3 and tubing string 1 are metal-to-metal supported on shoulder 18. Above pack-off device 16, hanger member 3 is provided with hold-down segments 21 engaged in a groove in the surrounding wall of body 2, segments 21 being releasable by downward movement of a segment retracting ring 22 carried by the hanger member 3. Above ring 22, member 3 is of reduced outer diameter and, at its upper end, is provided with a transverse annular outwardly opening locking groove 23.

Mandrel 4 is an integral tubular metal piece having an elongated portion 24 dimensioned to be received in bore portion 8 of hanger member 3, the lower end of portion 24 being internally threaded for conventional threaded connection to the tubing string. At the upper end of portion 24, the mandrel has a downwardly and inwardly tapering series of frustoconical shoulders 25 adapted for flush engagement with inner support shoulder 9 of hanger member 3. As best seen in FIGS. 2 and 3, the outer diameter of shoulders 25 are substantially smaller than that of shoulder 9. Mandrel 4 is completed by an upwardly projecting tubular portion 26 having an outer diameter substantially smaller than that of shoulders 25, the right cylindrical outer surface of portion 26 thus terminating at its lower end at a transverse annular upwardly directed series of shoulders 27, FIGS. 2 and 3. The right cylindrical inner surface of portion 26 defines an upwardly opening receptacle 28.

Figure 6:
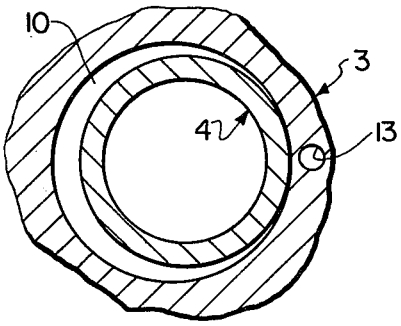
FIG. 6 is a top plan sectional view taken along lines 6—6 in FIG. 1 showing the hanger mandrel eccentrically supported in the hanger member and the crescent-shaped fluid passageway formed therebetween.
Figure 7:
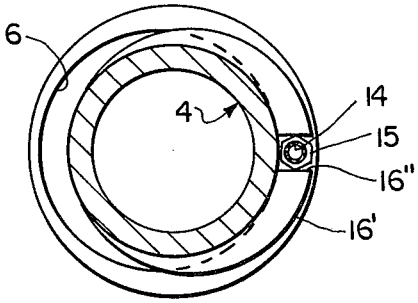
FIG. 7 is a bottom plan sectional view taken along lines 7—7 in FIG. 1 showing a crescent-shaped locking member with a slot to receive the down hole safety valve fitting, thereby preventing rotation of the hanger mandrel relative to the hanger member.

The hanger mandrel 4 is suspended in the hanger member 3 eccentrically, as best seen in FIGS. 1 and 6, thereby providing a crescent-shaped fluid passageway 10 therebetween below shoulder 9. This fluid passageway 10 or flow means communicates at its bottom with the annulus 10' surrounding the tubing string 1 and communicates at its top, via slots 27' between ribs 27" on the hanger mandrel 4, with the space 10" within the through bore above shoulder 9. These ribs 27", as seen in FIGS. 1 and 6, are defined on the top by shoulders 27 and at the bottom by shoulders 5. A crescent-shaped member 16' is coupled rigidly to the hanger mandrel 4 and has a vertical slot 16" at the largest extent of the crescent-shaped member to receive the fitting 15 for the downhole safety valve tube 14. This prevents relative rotation of the hanger mandrel 4 and the hanger member 3. These two elements, i.e., member 3 and mandrel 4, are fitted together by initially sliding one into the other and then rotating them relative to one another through 180° into the position shown in FIG. 1.

Annulus check valve 5 comprises an upper annular member 29 and a lower movable annular member 30. Member 29 has a right cylindrical outer surface tightly embraced by the wall of bore portion 7 of hanger member 3. Member 29 is rigidly restrained against upward movement by a snap ring 31 of the type described in detail in my copending application Ser. No. 120,045, filed Feb. 11, 1980 and now U.S. Pat. No. 4,317,587, or four ring segments and is restrained against downward movement by the tight fit between member 29 and the wall of bore portion 7 and screw members threaded into member 29 (see FIG. 3). Member 29 carries an O-ring 32 to seal between the outer surface of member 29 and the wall of bore portion 7. At its lower end, member 29 has an upwardly and inwardly tapering frustoconical surface 33 constituting the valve seat. The inner surface 34 of member 29 is right cylindrical and concentric with bore portion 7 and the upwardly projecting portion 26 of mandrel 4.

Annular member 30 has a right cylindrical inner surface 35 slidably embracing the outer surface of portion 26, surface 35 being grooved to accommodate an O-ring 36 to seal between surface 35 and the outer surface of portion 26. Member 30 is axially elongated in comparison with member 29 and includes a lower portion 37 located below member 29, an intermediate portion 38 which extends upwardly through member 29, and an outwardly enlarged upper end portion 39 which is located above member 29 and has a flat upwardly exposed end face 40 serving as an actuating surface. Lower portion 37 has an outer diameter which is substantially larger than that of surface 34 of upper annular member 29 but substantially smaller than the diameter of the wall of bore portion 7. Relatively thin, intermediate portion 38 has an outer diameter substantially smaller than the diameter of surface 34. Since members 29 and 30 are concentric, there is a substantial annulus between portion 38 and surface 34 to accommodate fluid flow when the valve is open. The outer surfaces of portions 37 and 38 are interconnected by a frustoconical valve surface 41 which tapers upwardly and inwardly at the same angle as does valve seat 33. Valve surface 41 is grooved to accommodate an O-ring 42 to seal between surface 41 and seat 33 when the valve is closed.

The lower end of portion 37 of member 30 presents a flat transverse annular surface directed toward shoulder 27 on hanger mandrel 4. At points centrally spaced along shoulders 27, mandrel 4 is provided with sockets 43 which open upwardly toward the lower end of member 30 and each retain a compression spring 44. Thus, springs 44 constitute yieldable means engaged with member 30 and urging that member in a direction to close the valve. The axial length of movable member 30 is such that, even when the movable valve member has been pushed downwardly, against the biasing action of springs 44, to the open position seen in FIG. 2, end face 40 is still spaced above the upper end of portion 26 of mandrel 4.

The hanger apparatus comprising member 3, mandrel 4 and valve 5 is adapted to be landed with the aid of a multifunction handling tool, indicated generally at 45, FIG. 1, which is advantageously of the general type described in detail in my copending applications Ser. Nos. 120,044 and 120,851, filed Feb. 11, 1980 and now U.S. Pat. Nos. 4,340,117 and 4,298,067. Modified for this invention, handling tool 45 comprises an upper body 46 secured to the lower end 47 of a composite handling joint, as by threads at 48. The upper end portion of a tubular outer member 49 embraces and is secured to body 46, as by a fastener ring 50 constructed according to my copending application Ser. No. 120,046, filed Feb. 11, 1980 and now U.S. Pat. No. 4,319,773. Body 46 has a central through bore accommodating a tubular member 51 having a downwardly projecting end portion 52 dimensioned to be telescopically received within the receptacle 28 defined by portion 26 of mandrel 4.

Handling tool 45 includes a remotely operated coupling, indicated generally at 55, FIG. 1, of the type described in my copending application Ser. No. 120,047, filed Feb. 11, 1980 and now U.S. Pat. No. 4,298,064. Coupling 55 comprises a circularly arranged series of locking segments 56 which are of generally C-shaped radial cross section, and an annular actuating piston 57 which surrounds and is spaced outwardly from member 51 and is housed within tubular member 49. To provide expansible chambers at 58, 59 for operating piston 57, a fixed seal ring 60 is secured to member 49 and slidably embraces the piston, a second seal ring 61 is secured to the upper end of the piston and is slidably embraced by member 49, and the body of the piston is outwardly enlarged at 62 to be slidably embraced by member 49. Pressure fluid, supplied via the handling string (not shown) is conducted to and from chambers 58, 59 via rigid tubes which extend through and are slidable within appropriate through bores in body 46 and have their lower ends secured to the piston. Thus, one such tube 63 is seen in FIG. 1 and communicates with an upwardly opening bore 64 in piston 57, there being a lateral bore 65 communicating between bore 64 and chamber 59, so that pressure fluid supplied via tube 63 and bores 64, 65 is effective to drive piston 57 downwardly within member 49.

In a location spaced below seal ring 60, member 49 is of increased wall thickness and is formed with an upwardly directed downwarldy and inwardly tapering frustoconical loadbearing shoulder 66. Immediately above shoulder 66, the inner wall of member 49 is recessed to accommodate segments 56 when, with piston 57 having been driven upwardly, the segments are retracted to their outer, inactive positions. When, as seen in FIG. 1, piston 57 has been driven downwardly, the lower arms of segments 56 are inserted into the annular space between shoulder 66 and the upper wall 67, FIG. 2, of groove 23, so that the full weight of tubing string 1 and the hanger apparatus can be supported via member 49, body 46 and the handling string. Member 49 extends below shoulder 66, being dimensioned to slidably embrace the upper portion of hanger member 3, and houses a plurality of pistons 68 which can be driven downwardly, by pressure fluid supplied via duct 69, to force ring 22 downwardly and retract latch segments 21 so as to release the hanger apparatus from the handling tool in the manner described in my copending application Ser. No. 120,052, filed Feb. 11, 1980 and now U.S. Pat. No. 4,290,483.

As seen in FIG. 2, in a location below shoulder 66, tubular member 51 is embraced by a ring 70 having a right cylindrical outer surface dimensioned to be slidably embraced by the wall of upper bore portion 7 of hanger member 3. At its inner periphery, the upper face of ring 70 engages a downwardly facing shoulder 71 on member 51. Below ring 70, member 51 has a transverse annular outwardly opening groove 72. A retaining member 73, made up of two semi-circular halves, has an inturned flange 74 and is assembled on member 51 with flange 74 engaged in groove 72, member 73 then being fixed to the lower face of ring 70, as by screws 75, FIG. 2, to secure the ring in a predetermined position on member 51. Ring 70 is provided with an upwardly opening blind bore 76 intersected by a radial bore 77 which opens outwardly through the outer surface of the ring. As seen in FIGS. 1 and 2, a pressure fluid supply conduit 78 runs beside member 51, extending through a bore in body 46 and freely through the space between member 51 and piston 57, the lower end of the conduit being fixed to ring 70 in communication with the upper end of bore 76. The wall of upper bore portion 7 of hanger member 3 is provided with a transverse annular inwardly opening groove 79. The outer surface of ring 70 is grooved above and below radial bore 77 to accommodate O-rings 80 to seal between ring 70 and the wall of bore portion 7 in areas respectively above and below groove 79 when, connector 55 having been actuated to couple hanger member 3 to the handling tool, ring 70 occupies the position seen in FIG. 2. Groove 79 communicates with lateral bore 12 in bore portion 7.

Retaining member 73 presents a flat circular lower face dimensioned to overlie upper end face 40 of movable valve member 30 as tubular member 51 is inserted downwardly into receptacle 28 of mandrel 4. The position of ring 70 and the axial thickness of retaining member 73 are such, relative to the position and dimensions of valve 5, that as the hanger member is secured to the handling tool by connector 55, retaining member 73 acts as an actuating member for the valve, engaging upper end face 40 of movable valve member 30 and forcing that member downwardly, against the biasing action of springs 44, to open the valve. With the valve open, there is communication with the annulus 10' surrounding tubing string 1 via passageway 10, slots 27' the open valve, at least one through bore 81 in ring 70, the annulus between piston 57 and member 51, and ducting, as at 82, extending via the handling string to the surface of the body of water.

When, after successful landing of the hanger member, connector 55 is actuated to disconnect from the hanger member and the handling tool is withdrawn, removal of retaining member 73 from engagement with member 30 allows springs 44 to move member 30 upwardly to the position seen in FIG. 3, closing the valve. Any annulus pressure further activates the valve 30. If it is necessary to recover the tubing string and hanger, the handling tool can again be connected to the hanger, with the positional relationships again being established as seen in FIG. 1. Connection of the handling tool to the hanger involves only axial movements, constituting a simple stab-in operation, followed by remote operation of the coupling, and the simple stab-in operation is effective both to open, and hold open, the annulus check valve and to establish and maintain communication, from the handling tool through the by-pass duct of the hanger member, with the conduit running to the down-hole safety valve.

Figure 4:
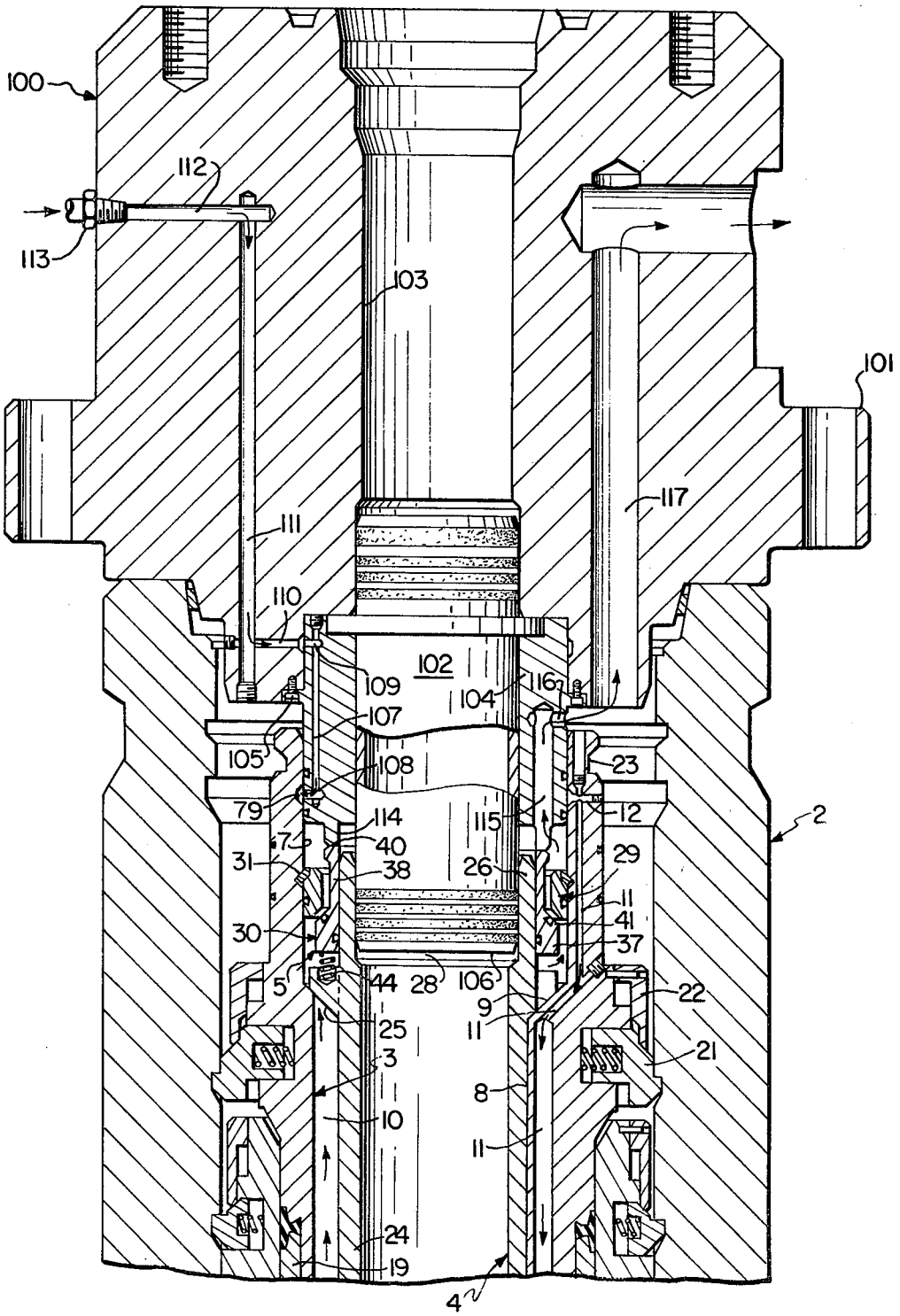
FIG. 4 is a vertical sectional view showing the condition of the hanger apparatus after a production upper body has been landed.
Figure 5:
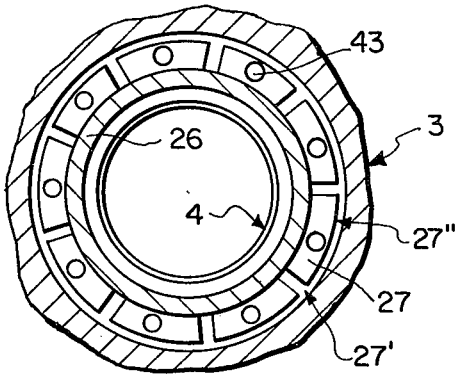
FIG. 5 is a top plan sectional view taken along lines 5—5 in FIG. 1 showing the ribs on the hanger mandrel and the slots therebetween.

As seen in FIG. 4, the same simultaneous opening of the annulus check valve and establishment of communication with the down-hole safety valve results automatically when production upper body 100 is installed. Body 100 is fitted to the top of lower body 2 in usual fashion and includes an outwardly projecting flange 101 to which a remotely operated connector (not shown), constructed generally as described in U.S. Pat. No. 3,228,715, issued Jan. 11, 1966, to Neilon et al, is secured for clamping body 100 to body 2. A dependent tubular member 102 has its upper end telescopically received in the through bore 103 of body 100 and is rigidly secured to that body by a surrounding dependent ring member 104, the latter being fixed to body 100, as by screws 105. Member 102 has a lower end portion 106 which projects downwardly a substantial distance beyond ring member 104 and is dimensioned to be slidably received within receptacle 28 of the upwardly projecting tubular portion 26 of mandrel 4. The right cylindrical outer surface of ring member 104 is sized to be slidably embraced by the wall of upper bore portion 7 of hanger member 3. The ring member is provided with an upright duct 107 intersected by a radial bore 108 which opens outwardly through the outer surface of the ring member in a location such that, when body 100 is seated on body 2 as shown, bore 108 opens into groove 79 of the hanger member and therefore communicates with bore 12 of the hanger member, and thus with by-pass duct 11 and conduit 14, regardless of the rotational position of body 100 relative to hanger member 3. At its upper end, duct 107 is intersected by a radial bore 109 which in turn communicates via ducts 110–112 with an external conduit (not shown) connected to body 100 by fitting 113.

The lower end of ring member 104 includes a dependent tubular skirt 114 which is concentric with and spaced outwardly from member 102, the diameter and radial thickness of skirt 114 being such that, as the lower end portion of member 102 approaches its fully inserted position in receptacle 28, the tip of skirt 114 engages upper end face 40 of valve member 30 and forces that valve member downwardly to its open position. Thus skirt 114 of body 100 serves as the valve actuating member in the same general fashion as does retaining member 73 of handling tool 45.

Communication with valve 5 through body 100 is provided by an upright bore 115 which opens through the lower end of skirt 114 and is intersected by a radial bore 116 which opens outwardly into the annulus surrounding ring member 104 below body 100 and then communicates with ducting 117 in body 100.

It will be noted that both handling tool 45 and production upper body 100 are so constructed and arranged as to cooperate with a fixed member of the assembly to determine predetermined vertical positions for the valve actuating member and the radial duct which is to communicate with the by-pass duct. In the case of handling tool 45, the tool is necessarily positioned to bring segments 56 into operative engagement with the upper wall of groove 23, and such positioning of the handling tool inherently locates valve actuating member 73 and ring 70 in their predetermined operative positions relative to hanger member 3. In the case of body 100, ring member 104 is operatively located relative to hanger member 3 whenever body 100 is successfully landed on body 2.

EMBODIMENT OF FIGS. 8–10

Figure 9:
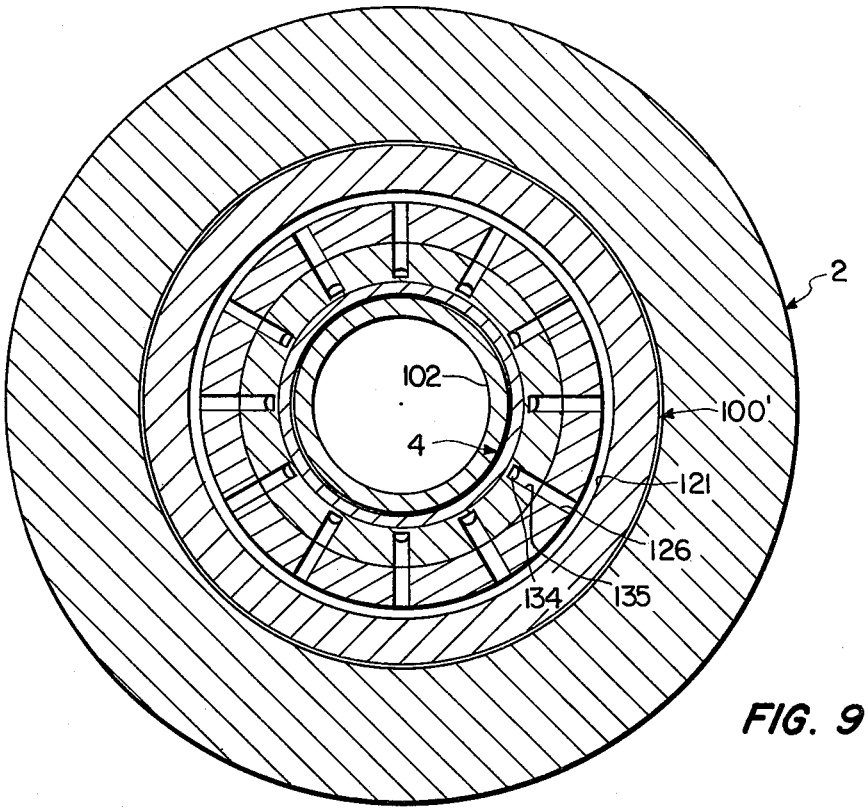
FIG. 9 is a top plan sectional view taken along lines 9—9 in FIG. 8.

A modified hanger apparatus is shown in FIGS. 8–10 with a modified annulus check valve. In this embodiment the check valve is opened by landing of the handling tool and closed by removal of this tool as in the embodiment of FIGS. 1–7; however, landing of the production upper body does not open the valve unless hydraulic pressure is specifically supplied to the valve. Relief of this hydraulic pressure or removal of the production upper body allows the valve to close under spring pressure. In this modified embodiment the down-hole safety valve hydraulic by-pass is substantially the same as in the embodiment of FIGS. 1–7.

As seen in FIG. 8 the production upper body 100' has been landed on the wellhead lower body 2 which has the hanger member 3' supported therein. This hanger member supports the hanger mandrel 4' which carries the modified annulus check valve 5'.

The production upper body 100' is substantially the same as upper body 100 described above regarding FIGS. 1–7 and includes a through bore 103, ducts 110, 111 and 112, a fitting 113 and an L-shaped duct 117. It also includes lower ring member 104 with radial bores 108 and 109 connected via vertical bore 107. Member 102 is located inside of ring member 104 and is coupled thereto.

In addition, the upper body 100' has a lower annular extension 120 extending between the lower body 2 and hanger member 3' and having an enlarged bore 121 communicating with duct 117. It also has a hydraulic fluid duct 122 (with an external connection with hydraulic fluid under pressure, not shown) that has a vertical portion communicating with an annular cavity 123 located between the upper body 100' and the top of ring member 104. This ring member has a vertical duct 124 communicating with cavity 123 and the annular space 125 between the bottom of the ring member 104 and the top of the check valve 5'. Thus, hydraulic fluid conducted through duct 122, cavity 123, duct 124 and space 125 acts on valve 5' to open it as desired.

The hanger member 3' is substantially the same as hanger member 3 discussed above regarding FIGS. 1–7 and includes the hydraulic fluid by-pass comprising lateral bore 12 and duct 11.

In addition, hanger member 3' has a plurality of outwardly and upwardly angled through bores 126 passing through upper portion 7. These bores 126 pass annulus fluid therethrough, when valve 5' is open, to the annular space defined by enlarged bore 121 in the production upper body 100' and then to duct 117, which communicates with bore 121.

Upper portion 7 of member 3' also has on its inner cylindrical surface a short vertical recess 127 to rotationally orient the valve 5' by receiving a spring biased finger 128 therein. A stop ring 129 of diamond-shape cross-section is received in a suitable annular groove in the inner surface of upper portion 7 above diagonally oriented bores 126. This ring limits the upward movement of valve 5' as it is moved to the closed position.

The modified check valve 5' is supported on hanger mandrel 4' as in the embodiment of FIGS. 1–7 and includes an integrally formed valve ring 130 and a coiled spring 131 which tends to bias the valve ring 130 upwardly into the closed position. Valve ring 130 has a reduced diameter inner bore 132 defining a downwardly facing annular shoulder 133, with spring 131 acting between this shoulder 133 and the shoulders 27 of ribs 27' on hanger mandrel 4'. Spring-biased finger 128 is received horizontally in the lower portion of ring 130 and extends radially outward into recess 127.

A plurality of fluid passageways are defined in the ring 130 and are spaced circumferentially around the ring, each passageway including a short vertical bore 134 and an outwardly and upwardly angled bore 135. Bores 134 and 135 are in fluid flow communication, with bore 135 having the same diagonal orientation as bores 126 in upper portion 7. Bore 134 extends upwardly from shoulder 133 formed in the ring 130.

Bores 135 are in fluid flow communication with bores 126 when the valve 5' is open, as seen in FIG. 8. The inner and outer cylindrical walls of valve ring 130 have suitable sealing rings therein to prevent fluid flow upwardly past ring 130, these walls slidably embracing, respectively, the outer wall of hanger mandrel 4' and the inner wall of upper portion 7.

In operation, valve 5' is normally in the closed position shown in FIG. 10 with spring 131 biasing valve ring 130 upwardly so that bores 126 and 135 are not aligned. This prevents fluid flowing upwardly through passageway 10 between hanger mandrel 4' and hanger member 3' and through slots 27' between the ribs 27'' from escaping past valve 5'.

To open valve 5', hydraulic pressure from duct 124 acts to push ring 130 downwardly against the spring 131 until the ring is landed on the tops of ribs 27'', as seen in FIG. 8. In this position, bores 126 and 135 are aligned. This allows the fluid in passageway 10 to flow upwardly through the slots 27', past spring 131 in enlarged bore 132, through bores 134 and 135 and into bores 126. Since bores 126 communicate via enlarged bore 121 with duct 117, this fluid can flow out of bores 126 into duct 117 and then out of the production upper body 100'.

EMBODIMENT OF FIG. 11

FIG. 11 is a fragmentary vertical sectional view similar to that shown in FIG. 3 and illustrating a modified annulus check valve 5'' in the closed position after removal of the handling tool. The valve 5'' shown in FIG. 11 has the annular member 29' rigidly coupled to mandrel 4 and the movable annular member 30' slidably engaging the hanger member 3, whereas in FIG. 3 these parts are reversed.

What is claimed is:

1. In an apparatus for hanging at least one string of pipe in a well bore while maintaining the capability of access through the apparatus to the annulus between the pipe being hung and surrounding casing as well as communication with a down-hole device such as a safety valve, the combination of a hanger member comprising means presenting a downwardly directed support surface adapted to be landed on a upwardly directed surface of a well member, a transverse inner upwardly directed support surface, a through bore extending downwardly from the inner support surface, generally tubular upper portion projecting upwardly from the inner support surface and surrounding the through bore, and a by-pass duct extending from a lower opening, through at least a portion of the generally tubular upper portion, to an upper opening, the lower opening of the bypass duct being adapted for connection to a pressure fluid conduit disposed in the annulus between the pipe to be hung and surrounding casing, the upper opening being adapted to communicate with a duct in a superadjacent member;

a hanger mandrel comprising a body portion adapted to be connected to the pipe to be hung, the body portion being dimensioned to extend through the through bore of the hanger member, a transverse downwardly directed support surface adapted to be seated on the inner support surface of the hanger member, and a generally tubular upwardly projecting portion disposed to be concentric with and spaced inwardly from the generally tubular upper portion of the hanger member when the mandrel is seated on the hanger member, the hanger mandrel including surface portions disposed to define at least one flow passage communicating between the space between the body portion of the mandrel and the wall of the through bore of the hanger member, on the one hand, and the space between the upwardly projecting portion of the mandrel and the generally tubular upper portion of the hanger member, on the other hand, when the mandrel is seated on the hanger member; and a remotely operated valve comprising an annular valve member embracing the upwardly projecting portion of the mandrel and movable between an upper closed position, in which the valve prevents flow of fluid through the space between the upwardly projecting portion of the mandrel and generally tubular upper portion of the hanger member, and a lower open position, in which the valve permits such flow, and a yieldable biasing device urging the valve member to its upper position.

2. The combination defined in claim 1, wherein the remotely operated valve further comprises an second annular valve member rigidly coupled to the hanger member and engageable with the annular valve member when the annular valve member is in the upper closed position.

3. The combination defined in claim 1, wherein the annular valve member has at least one fluid passageway therethrough, and the hanger member has at least one fluid passageway therethrough in fluid flow communication with the fluid passageway in the annular valve member when the annular valve member is in the lower open position.

4. In apparatus for hanging at least one string of pipe in a well bore while maintaining the capability of access through the apparatus to the annulus between the pipe being hung and surrounding casing and communication with a down-hole device such as a safety valve, the combination of a hanger member comprising means presenting a downwardly directed support surface adapted to be landed on an upwardly directed surface of a well member, a transverse inner upwardly directed support surface, a through bore extending downwardly from the inner support surface, a generally tubular upper portion projecting upwardly from the inner support surface and surrounding the through bore, a by-pass duct extending from a lower opening, through at least a portion of the generally tubular upper portion, to an upper opening, the lower opening of the by-pass duct being adapted for connection to a pressure fluid conduit disposed in the annulus between the pipe to be hung and surrounding casing, the upper opening being adapted to communicate with a duct in a superadjacent member, and flow means between said annulus and the space above the inner support surface and within the generally tubular upper portion;

a hanger mandrel comprising a body portion adapted to be connected to the pipe to be hung, the body portion being dimensioned to extend through the through bore of the hanger member, a transverse downwardly directed support surface adapted to be seated on the inner support surface of the hanger member, and a generally tubular upwardly projecting portion disposed to be concentric with and spaced inwardly from the generally tubular upper portion of the hanger member when the mandrel is seated on the hanger member; and valve means comprising a first annular member carried by one of said generally tubular upper portion of the hanger member and said upwardly projecting portion of the hanger mandrel and presenting a downwardly directed valve seat disposed in the space between the tubular upper portion of the hanger member and the upwardly projecting portion of the hanger mandrel, a second annular member slidably engaging the other of said generally tubular upper portion of the hanger member and said upwardly projecting portion of the hanger mandrel and presenting an upwardly directed valve surface dimensioned for operative engagement with the downwardly directed valve seat, and yieldable means biasing the second annular member toward the first annular member to engage the upwardly directed valve surface with the valve seat, the second annular member including an upwardly exposed portion engageable from above to effect opening of the valve means.

5. The combination defined in claim 4, wherein the first annular member of the valve means is carried by the generally tubular upper portion of the hanger member; and the second annular member of the valve means slidably embraces the upwardly projecting portion of the hanger mandrel.

6. The combination defined in claim 5, wherein the generally tubular upper portion of the hanger member has a cylindrical inner surface;

the inner upwardly directed support surface of the hanger member is a frustoconical shoulder tapering downwardly and inwardly from the inner surface of the tubular upper portion;

the downwardly directed support surface of the hanger mandrel is a frustoconical shoulder dimensioned for flush engagement with the frustoconical shoulder of the hanger member and having an outer diameter larger than the transverse dimension of the upwardly projecting portion of the hanger mandrel, there being a transverse annular upwardly facing shoulder portion on the hanger mandrel at the base of the upwardly projecting portion; and the yieldable means of the valve means comprises compression spring means engaged between the last-mentioned shoulder portion and the second annular member of the valve means.

7. The combination defined in claim 6, wherein the flow means comprises a passageway between the hanger member and the hanger mandrel.

8. The combination defined in claim 4, wherein the first and second annylar members of the valve means present coaxial cylindrical surfaces which are spaced apart to provide an annulus communicating with the flow means of the hanger member when the valve means is open.

9. The combination defined in claim 4, wherein the upper opening of the by-pass duct is directed laterally of the generally tubular upper portion of the hanger member.

10. In a tubing hanger apparatus, the combination of a hanger member comprising a hanger body having an axial through bore including an upper portion of larger diameter, a lower portion of smaller diameter, and a downwardly and inwardly tapering frustoconical support shoulder interconnecting the upper and lower bore portions, and means carried by the hanger body and presenting an outer downwardly directed support surface;

a hanger mandrel comprising a downwardly directed shoulder seated on the frustoconical shoulder of the hanger member body, a lower portion extending downwardly through the lower portion of the through bore of the hanger member body, and an upwardly projecting tubular portion concentric with and spaced inwardly from the wall of the larger diameter upper portion of the through bore of the hanger member body;

means defining a fluid passageway between the hanger member and the hanger mandrel;

an annulus check valve located in the space between the upwardly projecting tubular portion of the hanger mandrel and the surrounding wall of the upper portion of the through bore of the hanger member body, the check valve comprising an upper annular member carried by one of said hanger body and said upwardly projecting tubular portion of the hanger mandrel and presenting a downwardly directed valve seat, a movable annular member slidably engaging the other of said hanger body and said upwardly projecting tubular portion of the hanger mandrel and presenting an upwardly directed surface dimensioned to coact with the valve seat, and yieldable means engaged with the movable annular member to urge that member toward the upper annular member to close the valve, the movable annular member having an upwardly exposed portion disposed for engagement by a super adjacent member to open the valve.

11. The combination defined in claim 10, wherein the upper annular member is embraced by the wall of the upper portion of the hanger member through bore; and the movable annular member slidably embraces the upwardly projecting portion of the hanger mandrel and includes a tubular shank extending upwardly through and spaced inwardly from the upper annular member, the upper end of the tubular shank of the movable annular member constituting said upwardly exposed portion of the movable annular member.

12. The combination defined in claim 11, wherein the upper portion of the through bore of the hanger member body extends upwardly beyond the upwardly protecting portion of the hanger mandrel; and the hanger member body has a pressure fluid by-pass duct which has an upper opening adjacent the upper end of the hanger member body and a lower opening which opens through a lower portion of the hanger member body in a location below the support shoulder of the hanger member body and external to the through bore.

13. The combination claim 12, wherein the upper opening of the by-pass duct is directed laterally.

14. The combination defined in claim 13, wherein the upper opening of the by-pass duct opens inwardly through the wall of the upper portion of the through bore in a location spaced above the upper end of the upwardly projecting portion of the hanger mandrel.

15. In apparatus for installing pipe in a well while maintaining access to the annulus surrounding the pipe, the combination of a hanger member having a through bore including an upper portion of larger diameter, a lower portion of smaller diameter, and a transverse annular inner support shoulder between the upper and lower portions, and means presenting an outer support surface adapted to be landed on a supporting well member;

a hanger mandrel having a lower portion dimensioned to be accommodated in the lower portion of the through bore of the hanger member and to be connected to the pipe to be installed, a downwardly directed support surface dimensioned to be seated on the inner support surface of the hanger member to support the mandrel on the hanger member, and a generally tubular upwardly projecting portion extending above the downwardly directed support surface, the transverse dimension of the upwardly projecting portion being substantially smaller than the diameter of the wall of the upper portion of the through bore of the hanger member;

an annulus check valve comprising a first annular member carried by one of a portion of the hanger member above the inner support surface of the hanger member and the upwardly projecting portion of the mandrel, the first annular member presenting a downwardly directed valve seat, a second annular member slidably engaged with the other of said portion of the hanger member and said upwardly projecting portion of the mandrel, the second annular member having an upwardly directed valve surface dimensioned to coact with the valve seat of the first annular member, and yieldable means urging the second annular member toward the first annular member to close the valve, the second annular member including an upwardly exposed actuating surface;

flow means through the hanger member communicating with the check valve and the annulus; and a handling tool comprising connector means for connecting the hanger member to the handling tool, a downwardly projecting tubular member dimensioned to telescopically engage the upwardly projecting portion of the mandrel, and valve actuating means constructed and arranged to engage the actuating surface of the second annular member of the valve, as the handling tool is connected to the hanger member, to force the second annular member downwardly and open the valve.

16. The combination defined in claim 15, wherein the second annular member slidably embraces the upwardly projecting portion of the mandrel; and the valve actuating means of the handling tool is carried by the downwardly projecting tubular member of the handling tool.

17. The combination defined in claim 16, wherein the hanger member is provided with a pressure fluid by-pass duct external to the through bore of the hanger member and having an upper opening adjacent the top of the hanger member and a lower opening at the bottom of the hanger member; and the handling tool is provided with a pressure fluid duct having a lower opening communicating with the upper opening of the by-pass duct when the handling tool is connected to the hanger member.

18. The combination defined in claim 17, wherein the upper opening of the by-pass duct opens inwardly through the wall of the upper portion of the through bore of the hanger member; and the handling tool comprises a ring embracing the downwardly projecting tubular member and dimensioned to be slidably embraced by the wall of the upper portion of the through bore of the hanger member, the pressure fluid duct of the handling tool including a lower end portion which opens outwardly through the ring, one of said ring and the wall of the upper portion of the through bore of the hanger member being provided with an annular groove with which the upper opening of the by-pass duct and the lower end portion of the pressure fluid duct of the handling tool will communicate regardless of the rotational orientation of the handling tool relative to the hanger member.

19. The combination defined in claim 18, wherein the downwardly projecting tubular member has a transverse annular downwardly facing shoulder engaging an upper portion of the ring; the ring is maintained in engagement with said last-mentioned shoulder by an annular retaining member secured to the downwardly projecting tubular member and engaged beneath the ring; and the annular retaining member constitutes the valve actuating means of the handling tool.

20. In an underwater well installation, the combination of well structure defining an upright bore and presenting an upwardly directed support surface;

a hanger member having a through bore including an upper portion of larger diameter, a lower portion of smaller diameter, and a transverse annular inner support shoulder between the upper and lower portions, and means presenting an outer support surface adapted to be landed on the upwardly directed support surface of the well structure;

a hanger mandrel having a lower portion dimensioned to be accommodated in the lower portion of the through bore of the hanger member and to be connected to the pipe to be installed, a downwardly directed support surface dimensioned to be seated on the inner support surface of the hanger member to support the mandrel on the hanger member, and a generally tubular upwardly projecting portion extending above the downwardly directed support surface, the transverse dimension of the upwardly projecting portion being substantially smaller than the diameter of the wall of the upper portion of the through bore of the hanger member;

an annulus check valve comprising a first annular member carried by one of a portion of the hanger member above the inner support surface of the hanger member and the upwardly projecting portion of the mandrel, the first annular member presenting a downwardly directed valve seat, a second annular member slidably engaged with the other of said portion of the hanger member and said upwardly projecting portion of the mandrel, the second annular member having an upwardly directed valve surface dimensioned to coact with the valve seat of the first annular member, and yieldable means urging the second annular member toward the first annular member to close the valve, tne second annular member including an upwardly exposed actuating surface;

flow means through the hanger member communicating with the check valve and the annulus; and a production body adapted to be secured to the well structure and comprising a downwardly projecting tubular member dimensioned to telescopically engage the upwardly projecting portion of the mandrel, and valve actuating means constructed and arranged to engage the actuating surface of the second annular member of the valve, as the production body is lowered into place on the well structure, to force the second annular member downwardly and open the valve.

21. The combination defined in claim 20, wherein the second annular member of the valve slidably embraces the upwardly projecting portion of the mandrel; and the valve actuating means of the production body is carried by downwardly projecting tubular member.

22. The combination defined in claim 20, wherein the hanger member is provided with a pressure fluid by-pass duct external to the through bore of the hanger member and having an upper opening adjacent the top of the hanger member and a lower opening at the bottom of the hanger member; and the production body is provided with a pressure fluid duct having a lower opening communicating with the upper opening of the by-pass duct when the production body is secured to the well structure.

23. The combination defined in claim 22, wherein the upper opening of the by-pass duct opens inwardly through the wall of the upper portion of the through bore of the hanger member; and the production body comprises a ring surrounding the downwardly projecting tubular member and dimensioned to be slidably embraced by the wall of the upper portion of the through bore of the hanger member, the pressure fluid duct of the production body including a lower end portion which opens outwardly through the ring, one of said ring and the wall of the upper portion of the through bore of the hanger member being provided with a transverse annular groove with which the upper opening of the by-pass duct and the lower end portion of the pressure fluid duct of the production body will communicate regardless of the rotational orientation of the production body relative to the hanger member.

24. In apparatus for supporting at least one string of pipe in a well, the combination of a pipe-supporting structure comprising outer means presenting a downwardly directed support surface adapted to be landed on a support surface of a cooperating well member, an upwardly projecting outer tubular portion located above said outer means, an upwardly projecting inner tubular portion concentric with and spaced inwardly from said outer tubular portion, first upright through passage means opening upwardly within said inner tubular portion, means for connecting pipe to the supporting structure and in communication with the through passage means, and second upright through passage means communicating with the space between said outer and inner tubular portions and opening downwardly through the supporting structure in a location external to the first through passage means; and a check valve comprising a first annular member carried by one of said outer tubular portion and said inner tubular portion and having a downwardly directed valve seat, a second annular member slidably engaged with the other of said outer tubular portion and said inner tubular portion and having an upwardly directed valve surface dimensioned to coact with the valve seat, and yieldable means biasing said second annular member upwardly to close the valve, said second annular member having an upwardly exposed portion engageable from above to open the valve.

25. A well having an annulus check valve, the combination comprising:

a well head lower body having a vertical bore therein;

an upper tubular member receivable on said well head lower body;

a hanger member supported in said vertical bore;

a hanger mandrel supported in said hanger member and having tubing extending downwardly therefrom;

said hanger mandrel and hanger member being spaced to define a fluid passageway therebetween;

a normally closed check valve, including a longitudinally slidable, annular valve member, located in and spanning said fluid passageway to prevent fluid flow in said fluid passageway; and means, carried by said upper tubular member, for opening said check valve when said upper tubular member is received on said well head lower body.

26. A well having an annulus check valve, the combination comprising:

a well head lower body having a vertical bore therein;

an upper tubular member receivable on said well head lower body;

a hanger member supported in said vertical bore;

a hanger mandrel supported in said hanger member and having tubing extending downwardly therefrom;

said hanger mandrel and hanger member being spaced to define a fluid passageway therebetween;

a normally closed check valve located in said fluid passageway to prevent fluid flow in said fluid passageway; and means, carried by said upper tubular member, for opening said check valve when said upper tubular member is received on said well head lower body, said means for opening said check valve comprising a rigid member coupled to said upper tubular member and adapted to engage said check valve and move it to an open position.

27. A well according to claim 25, wherein said means for opening said check valve comprises fluid pressure means carried by said upper tubular member and adapted to move said check valve to an open position.

28. A well having an annulus check valve, the combination comprising:

a well head lower body having a vertical bore therein;

a well head upper body receivable on said well head lower body;

a hanger member supported in said vertical bore;

a hanger mandrel supported in said hanger member and having tubing extending downwardly therefrom;

said hanger mandrel and hanger member being spaced to define a fluid passageway therebetween; and a normally closed check valve, including a longitudinally slidable, annular valve member, located in and spanning said fluid passageway to prevent fluid flow in said fluid passageway, said valve being opened upon reception of said well head upper body on said well head lower body.

29. A well according to claim 28, and further comprising fluid means for opening a down hole safety valve located in said tubing, said fluid means comprising a first fluid conduit located in said well head upper body, and a second fluid conduit located in said hanger member and coupled to the down hole safety valve, said first and second fluid conduits being in fluid flow connection when said well head upper body is received on said well head lower body.

30. A well having an annulus check valve, the combination comprising:

a well head lower body having a vertical bore therein;

a well head upper body receivable on said well head lower body;

a hanger member supported in said vertical bore;

a hanger mandrel supported in said hanger member and having tubing extending downwardly therefrom;

said hanger mandrel and hanger member being spaced to define a fluid passageway therebetween;

a normally closed check valve, including a longitudinally slidable, annular valve member, located in and spanning said fluid passageway to prevent fluid flow in said fluid passageway; and fluid pressure means, carried by said well head upper body, for opening said check valve when said well head upper body is received on said well head lower body.

31. A well according to claim 30, and further comprising fluid means for opening a down hole safety valve located in said tubing, said fluid means comprising a fluid conduit located in said well head upper body, and a second fluid conduit located in said hanger member and coupled to the down hole safety valve, said first and second fluid conduits being in fluid flow connection when said well head upper body is received on said well head lower body.

* * * * *